US010690462B2

(12) United States Patent
Gerfin et al.

(10) Patent No.: US 10,690,462 B2
(45) Date of Patent: Jun. 23, 2020

(54) SECONDARY MALFUNCTION TRAINING ROUND

(71) Applicants: Bryant Gerfin, Arlington, WA (US); Wayne Davis, Marysville, WA (US)

(72) Inventors: Bryant Gerfin, Arlington, WA (US); Wayne Davis, Marysville, WA (US)

( * ) Notice: Subject to any disclaimer, the term of this patent is extended or adjusted under 35 U.S.C. 154(b) by 274 days.

(21) Appl. No.: 15/848,865

(22) Filed: Dec. 20, 2017

(65) Prior Publication Data

US 2018/0195843 A1 Jul. 12, 2018

Related U.S. Application Data

(60) Provisional application No. 62/436,590, filed on Dec. 20, 2016.

(51) Int. Cl.

| | |
|---|---|
| ***F41A 33/00*** | (2006.01) |
| ***F42B 8/08*** | (2006.01) |
| ***F42B 8/02*** | (2006.01) |

(52) U.S. Cl.

CPC ..... *F42B 8/08* (2013.01); *F41A 33/00* (2013.01); *F42B 8/02* (2013.01)

(58) Field of Classification Search

CPC ..... F41A 33/00; F42B 8/08
USPC ..... 434/11, 16; 102/444, 529
See application file for complete search history.

(56) References Cited

U.S. PATENT DOCUMENTS

| | | | | | |
|---|---|---|---|---|---|
| 119,357 | A * | 9/1871 | Hobbs | F42B 8/02 | 102/444 |
| 2,882,821 | A * | 4/1959 | Benson | F42B 8/08 | 102/444 |
| 3,292,538 | A * | 12/1966 | Umbach | F42B 5/26 | 102/444 |
| 4,546,704 | A * | 10/1985 | Ballreich | F42B 8/02 | 102/444 |
| 5,291,832 | A | 3/1994 | Plummer | | |
| 6,189,454 | B1 | 2/2001 | Hunt | | |
| 6,223,657 | B1 | 5/2001 | Proffitt | | |
| 6,305,290 | B1 | 10/2001 | Stimmell et al. | | |
| 7,418,904 | B2 * | 9/2008 | Illesi | B21K 21/12 | 102/444 |
| 8,689,697 | B2 * | 4/2014 | Notomi | F41A 33/04 | 102/430 |
| 10,082,375 | B2 * | 9/2018 | McCloy | F42B 8/08 | |
| 2014/0096427 | A1 | 4/2014 | Bonner | | |

* cited by examiner

*Primary Examiner* — Kurt Fernstrom
(74) *Attorney, Agent, or Firm* — Boudwin Intellectual Property; Daniel Boudwin

(57) ABSTRACT

A device and method for producing a secondary malfunction of a cartridge extracted from a firearm. A cartridge case has a bullet disposed in a front end and a rim formed at a rear end. The rim is tapered toward a primer, wherein the primer is disposed in the center of the rim. The tapered rim prevents a firearm from successfully extracting the cartridge case, i.e. a secondary malfunction occurs.

13 Claims, 4 Drawing Sheets

SECONDARY MALFUNCTION TRAINING ROUND

CROSS REFERENCE TO RELATED APPLICATIONS

This application claims the benefit of U.S. Provisional Application No. 62/436,590 filed on Dec. 20, 2016. The above identified patent application is herein incorporated by reference in its entirety to provide continuity of disclosure.

BACKGROUND OF THE INVENTION

The present invention relates to firearm training rounds. Specifically, the present invention provides a firearm training that having a tapered rim designed to cause a secondary malfunction of the firearm, which occurs when a firearm fails to successfully extract a spent cartridge.

Secondary malfunctions of a firearm, also known as Type 2 malfunctions or stovepipe malfunctions, may occur even in the most reliable firearm platforms. For military and law enforcement personnel, the ability to quickly clear a malfunction during a hostile engagement is a matter of life and death. As such, the importance of proper training to clear a secondary malfunction cannot be understated.

Current firearm malfunction clearance training requires trainers to preset a secondary malfunction, meaning the training begins with the firearm already in a state of malfunction. This process causes foreshadowing, in which trainees already know of the malfunction before action is required to correct the malfunction, allowing students to review clearance procedures prior to clearing the malfunction. Therefore, a secondary malfunction training round that can be loaded into a magazine during a live-fire training scenario could greatly improve the efficacy of modern firearm training.

Several devices have been proposed to aid in the training of firearm malfunctions. One device provides a training round that possesses a rim with a width greater than the width of a firearm extractor, preventing the extractor from engaging the rim and causing a double feed malfunction. Another device provides an inert primer or firing cap for a cartridge casing to allow a trainee to practice clearing ammunition malfunctions without the danger of live rounds. However, these devices do not cause the secondary malfunction in live-fire training desirably caused by the present invention.

SUMMARY OF THE INVENTION

In view of the foregoing disadvantages inherent in the known types of training ammunition rounds now present in the prior art, the present invention provides a training round wherein the same can be utilized for providing convenience for the user when training an individual a procedure to clear round ejection malfunctions in a live-fire situation. The present device comprises a cartridge case having a bullet disposed in a front end and a rim formed at a rear end. The rim is tapered toward a primer, wherein the primer is disposed in the center of the rim. The tapered rim prevents a firearm from successfully ejecting the cartridge case.

One object of the present invention is to provide a training round with an primer and a tapered rim that causes a secondary malfunction in the extraction of the training round from a firearm.

Another object of the present invention is to provide a training round with a tapered rim, wherein the rim tapers toward a primer disposed in the center thereof, and a protrusion extending perpendicularly from the primer relative to a longitudinal axis extending between the rear end of the cartridge case to the front end of the cartridge case.

A further object of the present invention is to provide a method of inducing random secondary malfunctions in a firearm by loading a training round with a primer and a tapered rim into a magazine also containing live rounds.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
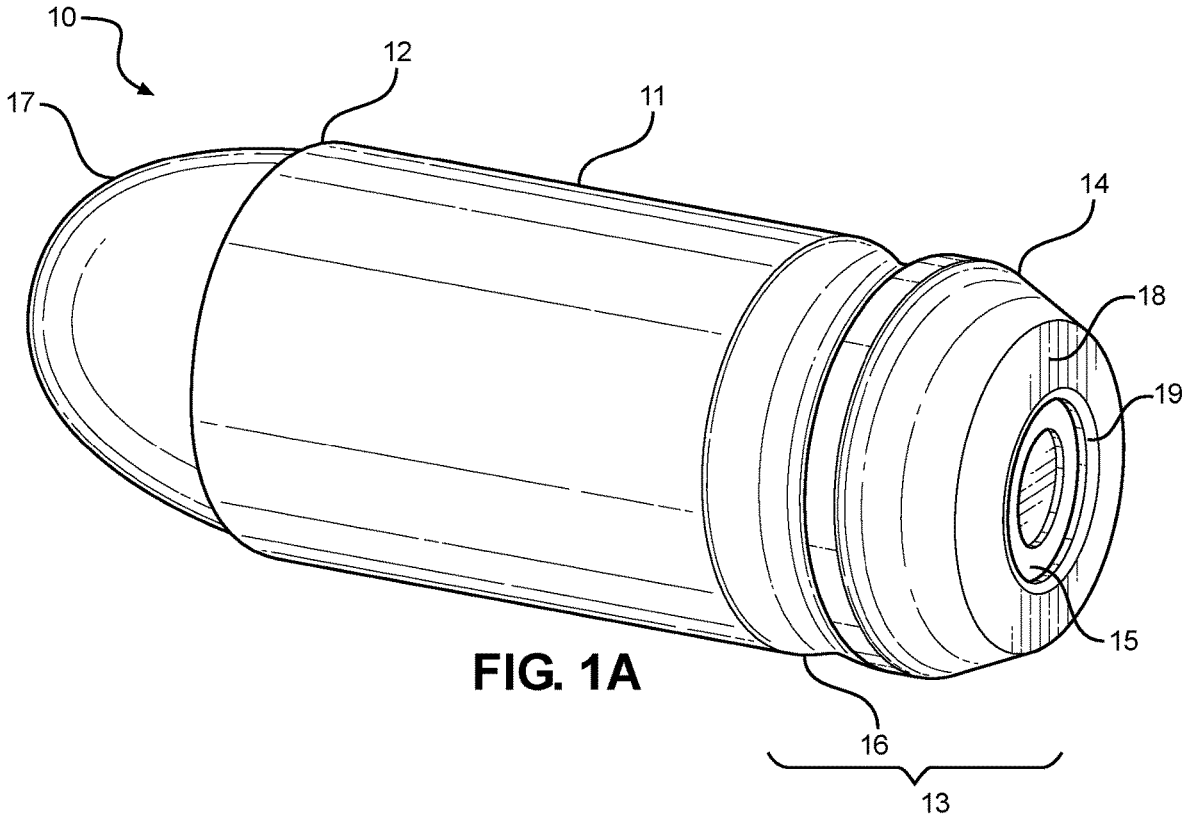
FIG. 1A shows a perspective view of a first embodiment of the secondary malfunction training round.

Reference is made herein to the attached drawings. Like reference numerals are used throughout the drawings to depict like or similar elements of the secondary malfunction training round. The figures are intended for representative purposes only and should not be considered to be limiting in any respect. Unless specifically limited to a single unit, "a" is intended to be equivalent to "one or more" throughout the present disclosure.

Figure 1B:
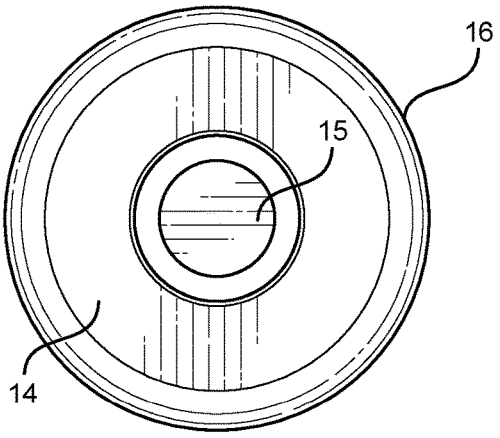
FIG. 1B shows an elevation view from the rear of a first embodiment of the secondary malfunction training round.

Referring now to FIGS. 1A and 1B, there is shown a perspective view of a first embodiment of the secondary malfunction training round and an elevation view from the rear of a first embodiment of the secondary malfunction training round, respectively. As seen in FIG. 1A, the secondary malfunction training round 10, comprises a cartridge case 11 having a front end 12 opposed to a rear end 18 and a tail portion 13. A bullet 17 is disposed in the front end 12, wherein the bullet 17 protrudes outward in the forward direction. The forward most part of the tail portion 13 of the cartridge case 11 is defined by a groove 16 circumscribing the cartridge case 11. Further towards the rear of the cartridge case 11 is a rim 14. In the illustrated embodiment, the rim 14 tapers from the groove 16 towards a primer 15, wherein the primer 15 is centrally disposed within an opening 19 in the rim 14 at a rear end 18 of the cartridge casing 11.

In a functioning ammunition round, an extractor engages, e.g. by friction, with the rim of the cartage case to push a spent cartridge case out of the firearm. However, the tapered nature of the rim 14 in the present invention changes the angle of engagement between the extractor of a firearm and the rim 14; thereby, reducing the efficacy of the extractor. Thus, the rim 14 of the secondary malfunction training round 10 prevents the extractor in the firearm from pushing the secondary malfunction training round 10 out of the firearm, and thereby causing the secondary malfunction of the firearm.

In some embodiments, the primer 15 is an inert primer, rendering the round incapable of firing. In use, the primer 15 is concussed by a firing pin of a firearm. In embodiments where the primer 15 is inert, to prevent damage to the firing pin, the primer 15 can be composed of a force reducing material, such as a synthetic polyethylene polymer. Thus, allowing the primer 15 to absorb the impact force of the firing pin striking the primer 15.

Figure 2A:
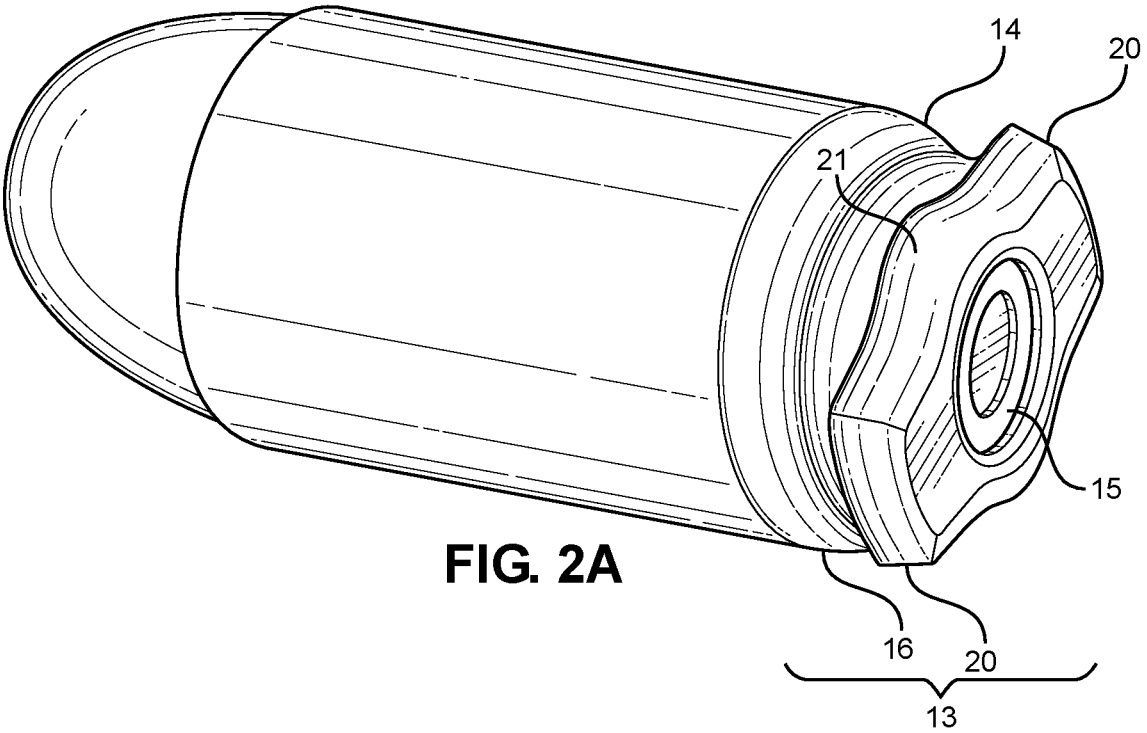
FIG. 2A shows a perspective view of a second embodiment of the secondary malfunction training round.
Figure 2B:
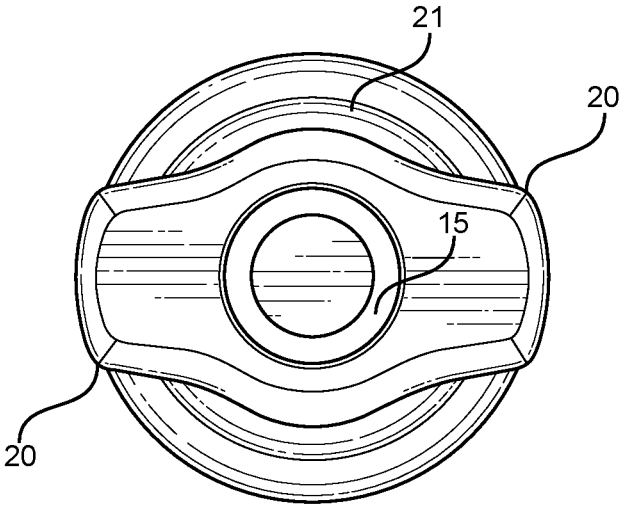
FIG. 2B shows an elevation view from the rear of second embodiment of the secondary malfunction training round.

Referring now to FIGS. 2A and 2B, there is shown a perspective view of a second embodiment of the secondary malfunction training round and an elevation view from the rear of a second embodiment of the secondary malfunction training round. In this second embodiment of the secondary malfunction training round, the rim 14 further comprises a pair of protrusions 20. The protrusions 20 extend outward from the primer 15 at the rear end 18 of the cartridge case 11 in opposing directions. The extension of the protrusions 20 is perpendicular from the primer 15 relative to a longitudinal axis extending between the rear end 18 and the front end 12 of the cartridge case 11. In some embodiments, the protrusions 20 extend outward a distance not less than and not greater than a radius of the cartridge case 11. Each protrusion 20 resembles a section of a standard cylindrical rim found on a live cartridge case.

Between each protrusion 20, a medial section 21 of rim 14 is disposed. This medial section 21 is tapered in the same manner that the rim 14 of the first embodiment is tapered, i.e. the medial section 21 is tapered from the groove 16 to the centrally located primer 15. This arrangement of protrusions 20 and tapered medial sections 21 provides a rim 14 with portions that can frictionally engage with the extractor of a firearm, i.e. the protrusions 20, and portions that cannot frictionally engage with the extractor of a firearm, i.e. the medial sections 21. Thus, the predictability of an occurrence of a secondary malfunction with this second embodiment of the secondary malfunction training round is reduced; thereby, enhancing a student's training for unpredictable secondary malfunctions occurring in a live-fire scenario.

Figure 3A:
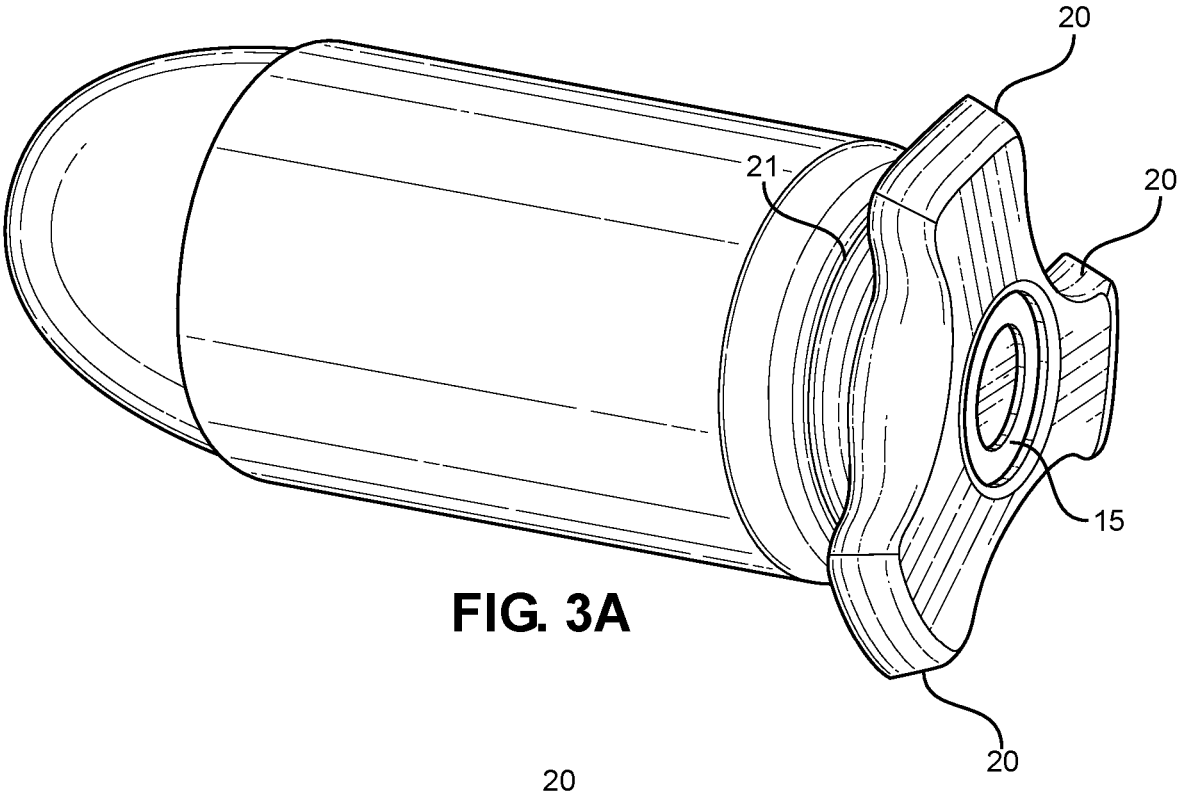
FIG. 3A shows a perspective view of a third embodiment of the secondary malfunction training round.
Figure 3B:
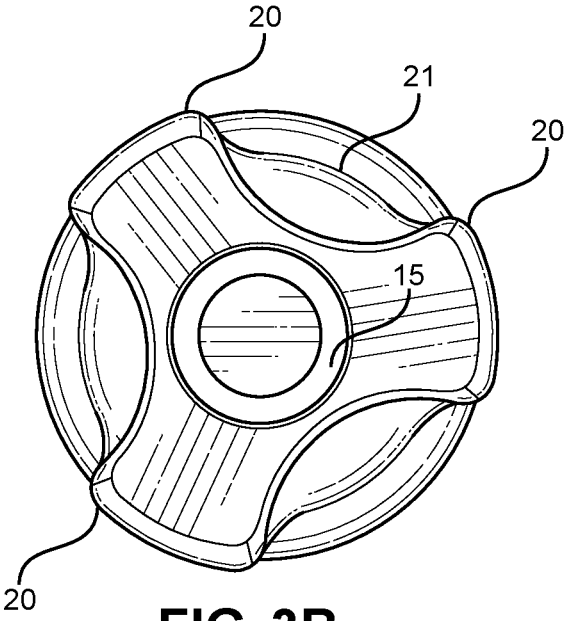
FIG. 3B shows an elevation view from the rear of a third embodiment of the secondary malfunction training round.

Referring now to FIGS. 3A and 3B, there is shown a perspective view of a third embodiment of the secondary malfunction training round and an elevation view from the rear of a third embodiment of the secondary malfunction training round. In this third illustrated embodiment, three protrusions 20 are radially disposed around the inert primer 15 and are spaced equally apart, resulting in the medial sections 21 of the rim 14 located between the protrusions 20 being of equal dimensions. Although this embodiment is shown with three protrusions 20, other embodiments may have any number of protrusions 20 radially disposed around the primer 15. Similar to the second illustrated embodiment, this arrangement of radially alternating protrusions 20 and medial sections 21 reduces the predictability of an occurrence of a secondary malfunction, further randomizing the corrective actions required in a training scenario.

Figure 4:
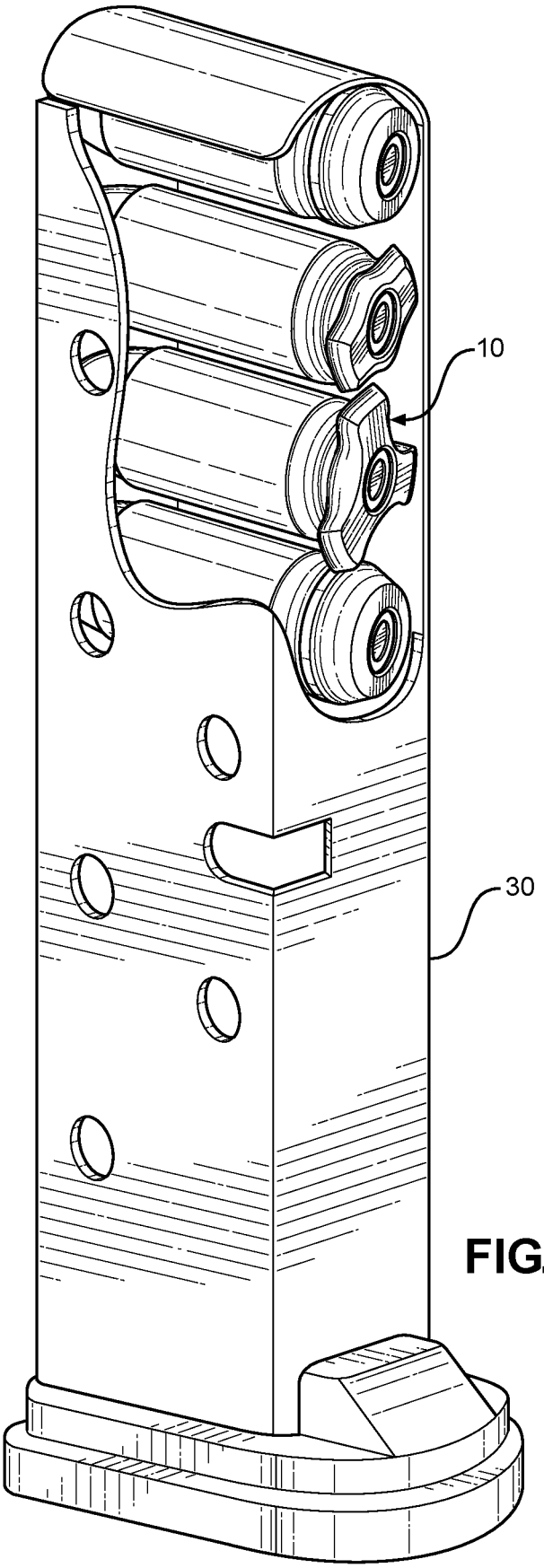
FIG. 4 shows a perspective view of a loaded magazine having a cut-out portion showing an alternating arrangement of loaded first, second and third embodiments of the secondary malfunction training round in the magazine.

Now referring to FIG. 4, there is shown a perspective view of a loaded magazine having a cut-out portion showing an alternating arrangement of loaded first, second and third embodiments of the secondary malfunction training round in the magazine. A method of loading rounds into a magazine 30, the result of which is shown in FIG. 4, comprises providing the user with an embodiment of the secondary malfunction round, loading the secondary malfunction training round into a magazine along with either standard inert training rounds or live-fire rounds, and then using the magazine 30 in a firearm to induce a secondary malfunction caused by the secondary malfunction training round 10.

Another method of loading the magazine 30 involves loading the magazine 30 with at least two different embodiments of the secondary malfunction training round 10, for example those embodiments shown in FIGS. 2A and 3A. In this method, the differing embodiments of the secondary malfunction training round 10 are loaded in a random alternating fashion, see FIG. 4. Utilizing this arrangement, the ejection of each round from the firearm becomes unpredictable, for example some rounds may eject completely, while others will remain entirely or partially jam in the chamber of the firearm.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A secondary malfunction training round, comprising:
- a cartridge case having a front end opposed to a rear end, the rear end including a tail portion;
- a bullet disposed within the front end;
- a rim formed at the tail portion;
- a primer disposed in the rim, wherein the rim tapers from a groove towards the primer.

2. The secondary malfunction training round of claim 1, wherein the primer is centered in the rim.

3. The secondary malfunction training round of claim 1, wherein the primer is inert.

4. The secondary malfunction training round of claim 1, wherein a protrusion extends outward perpendicularly from the primer relative to a longitudinal axis, the longitudinal axis extending between the rear end and the front end.

5. The secondary malfunction training round of claim 4, wherein the protrusion extends outward a distance not less than and not greater than a radius of the cartridge case.

6. The secondary malfunction training round of claim 4, wherein a pair of protrusions extend outward from the primer in opposing directions.

7. The secondary malfunction training round of claim 4, wherein the primer is inert.

8. The secondary malfunction training round of claim 4, wherein three protrusions extend outward from the primer, wherein the distance between each protrusion is equal.

9. The secondary malfunction training round of claim 8, wherein the primer is inert.

10. The secondary malfunction training round of claim 1, wherein the primer is a polymer insert.

11. A method of inducing a secondary malfunction in a firearm, comprising:

providing a secondary malfunction training round comprising a cartridge case a front end opposed to a rear end and a tail portion, a bullet disposed in the front end of the cartridge case, a rim formed in the tail portion of the cartridge case, and a primer disposed in the rim at the rear end of the cartridge case, wherein the rim tapers towards the primer;

loading the secondary malfunction training round into a magazine configured to be used with a firearm; and loading the magazine in a firearm.

12. The secondary malfunction training round of claim 11, wherein the primer is inert.

13. The secondary malfunction training round of claim 11, further comprising:

providing a second secondary malfunction training round, substantially similar to the secondary malfunction training round, having a protrusion extending outward perpendicularly from the primer relative to a longitudinal axis, the longitudinal axis extending between the rear end of the cartridge case to the front end of the cartridge case;

alternately loading the secondary malfunction training round and the second secondary malfunction training round into a magazine configured to be used with a firearm; and using the magazine in a firearm.

* * * * *